US009867431B2

(12) United States Patent
Harley

(10) Patent No.: US 9,867,431 B2
(45) Date of Patent: Jan. 16, 2018

(54) SHOE COVER STORAGE APPARATUS TO PROTECT LACES

(71) Applicant: Robert Dion Harley, Hagerstown, MD (US)

(72) Inventor: Robert Dion Harley, Hagerstown, MD (US)

( * ) Notice: Subject to any disclaimer, the term of this patent is extended or adjusted under 35 U.S.C. 154(b) by 185 days.

(21) Appl. No.: 14/821,027

(22) Filed: Aug. 7, 2015

(65) Prior Publication Data

US 2016/0037863 A1 Feb. 11, 2016

Related U.S. Application Data

(60) Provisional application No. 62/035,065, filed on Aug. 8, 2014.

(51) Int. Cl.

| | |
|---|---|
| ***A43B 3/00*** | (2006.01) |
| ***A43B 23/26*** | (2006.01) |
| ***A43C 7/00*** | (2006.01) |
| ***A43C 7/02*** | (2006.01) |
| ***A43C 13/00*** | (2006.01) |
| ***A43B 1/00*** | (2006.01) |

(52) U.S. Cl.

CPC ..... *A43C 13/00* (2013.01); *A43B 1/0081* (2013.01); *A43B 3/0031* (2013.01); *A43B 23/26* (2013.01); *A43C 7/005* (2013.01); *A43C 7/02* (2013.01)

(58) Field of Classification Search

CPC .. A43C 7/005; A43C 7/02; A43C 7/06; A43C 13/00; A43B 3/0031; A43B 23/26

USPC ..... 36/72 R, 136; 24/712.1–712.9

See application file for complete search history.

(56) References Cited

U.S. PATENT DOCUMENTS

| | | | | |
|---|---|---|---|---|
| 4,485,529 | A * | 12/1984 | Blum | A43C 7/005 24/128 |
| 4,536,975 | A | 8/1985 | Harrell | |
| 4,545,138 | A * | 10/1985 | Blum | A43C 11/20 24/712.2 |
| 4,630,383 | A | 12/1986 | Gamm | |
| 4,949,437 | A * | 8/1990 | Anderson | A43C 7/02 24/712.2 |
| 5,313,719 | A | 5/1994 | Koethe | |
| 5,459,947 | A | 10/1995 | Lasher | |
| 5,566,477 | A | 10/1996 | Mathis et al. | |
| 5,671,517 | A | 9/1997 | Gourley | |
| 5,701,688 | A | 12/1997 | Crowley | |
| 6,000,111 | A | 12/1999 | Deskins et al. | |

(Continued)

*Primary Examiner* — Sharon M Prange

(74) *Attorney, Agent, or Firm* — Mark H. Plager

(57) ABSTRACT

A shoe cover storage apparatus to protect shoelaces includes a flexible member coupled to the upper shoe region and having a pair of openings to permit a portion of the laces to pass through, a pocket coupled to the top face of the flexible member to store the portion of the laces, a first clip coupled to the bottom face of the flexible member, and a fastener assembly coupled to the bottom face of the flexible member and having channel members and an elastic cord slidably mounted to interior openings of the channel members, the elastic cord having a second clip on an exposed portion of the cord located proximate a lower portion of the flexible member. A user pulls the second clip to extend the cord along the flexible member to intertwine the cord with the shoelaces and permit the second clip to couple to the first clip.

4 Claims, 4 Drawing Sheets

(56) References Cited

U.S. PATENT DOCUMENTS

| | | | | |
|---|---|---|---|---|
| 6,560,903 | B1 * | 5/2003 | Darley | A43B 3/0031 24/712.2 |
| 6,601,323 | B2 * | 8/2003 | Tsujino | A43C 7/02 24/712.3 |
| 6,988,298 | B2 | 1/2006 | Ternasky et al. | |
| 7,640,640 | B1 | 1/2010 | Watkins | |
| 8,943,712 | B2 * | 2/2015 | Buck | A43B 3/105 2/245 |

* cited by examiner

SHOE COVER STORAGE APPARATUS TO PROTECT LACES

RELATED APPLICATION

The application claims priority to provisional patent application U.S. Ser. No. 62/035,065 filed on Aug. 8, 2014, the entire contents of which is herein incorporated by reference.

BACKGROUND

The embodiments herein relate generally to shoe covers.

There exists a variety of shoes with shoelaces including athletic shoes, other sneakers, boots, or the like. The laces on these shoes are exposed to the environment, which increases the chance they collect dirt and become frayed or damaged. This causes the shoe to become unattractive and/or impractical to use. As a result, there is a need to protect the shoelaces and provide an aesthetically appealing cover for these shoes.

Several shoe covers and/or lace protection devices are disclosed in U.S. Pat. Nos. 7,640,640, 6,988,298, 5,313,719, 6,000,111, 5,566,477, 5,701,688, 5,459,947, 5,671,517, 4,630,383 and 4,536,975, which are secured to the shoe and designed to cover at least a portion of the laces. However, these devices are limited for a variety of reasons including their inability to effectively cover and protect the entire portion of the shoe's laces and tongue. In addition, these devices do not adequately conform to contours of the upper shoe region for different shoe styles and sizes, thereby minimizing the practical use of the devices and comfort of the user. More importantly, these devices use a variety of hook and loop fasteners or alternative fastening components that provide rough surfaces that damage the laces. As a result, these securement mechanisms used are problematic and/or ineffective.

As such, there is a need in the industry for a shoe cover storage apparatus for use with a shoe that addresses the limitations of the prior art, which effectively covers the upper region of the shoe and conforms to contours of shoes having different styles and sizes. There is a further need for a shoe cover storage apparatus that effectively stores the shoelaces and provides a pocket to store various accessories.

SUMMARY

A shoe cover storage apparatus to secure and protect laces of a shoe is provided. The apparatus comprises an enhanced securement mechanism configured to permit the apparatus to conform to contours of an upper region of the shoe. The shoe cover storage apparatus comprises a flexible member detachably coupled to the upper shoe region and comprising a top face, a bottom face and a pair of openings configured to permit a portion of the laces to pass therethrough to extend above the top face, a pocket coupled to the top face of the flexible member and configured to store the portion of the laces, a first clip coupled to the bottom face of the flexible member, and a fastener assembly coupled to the bottom face of the flexible member and comprising channel members coupled thereto and an elastic cord slidably mounted to interior openings of the channel members, the elastic cord comprising a second clip on an exposed portion of the cord located proximate a lower portion of the flexible member, wherein a user pulls the second clip to extend the cord along a longitudinal axis of the flexible member to intertwine the cord with the laces of the shoe and permit the second clip to detachably couple to the first clip, thereby enabling the flexible member to bend into a concave shape that conforms to the upper shoe region.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
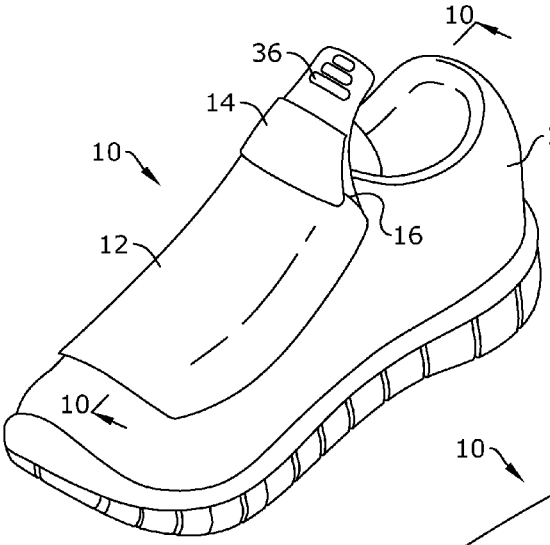
FIG. 1 depicts a perspective view of certain embodiments of the shoe cover storage apparatus shown in use.
Figure 2:
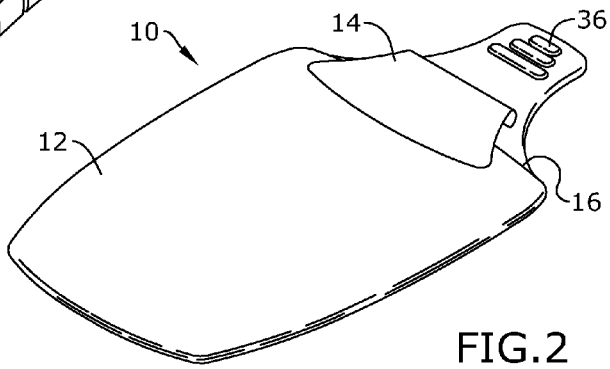
FIG. 2 depicts a top perspective view of certain embodiments of the shoe cover storage apparatus in a flat position.

As depicted in FIGS. 1-4, shoe cover storage apparatus 10 is configured to be secured to an upper region of shoe 38, and comprises cover body 12, top flap 14, pocket 16 and gripping ribs 36. Shoe cover storage apparatus 10 covers, stores and protects shoelace 40 of shoe 38.

Cover body 12 and top flap 14 are preferably made from a flexible material such as neoprene, leather, mesh plastic, other materials, or the like. Cover body 12 comprises a pair of lace holes 34 that permit ends of shoelace 40 to pass through the cover body from underneath the body to above the body. Top flap 14 is affixed to the top face of cover body 12 and is made from a stretchable material. Top flap 14 is configured to fold down and over the edge of pocket 16. Pocket 16 forms a hollow interior pouch that may have variable dimensions. In one embodiment, a plurality of gripping ribs 36 are affixed to the top of cover body 12 to provide a user an improved grip when grasping shoe cover storage apparatus 10. Gripping ribs 36 may be made from any material that enhances friction such as rubber. It shall be appreciated that cover body 12 and top flap 14 may include any decorative markings, patterns, logos, text, colors, or the like.

Figure 3:
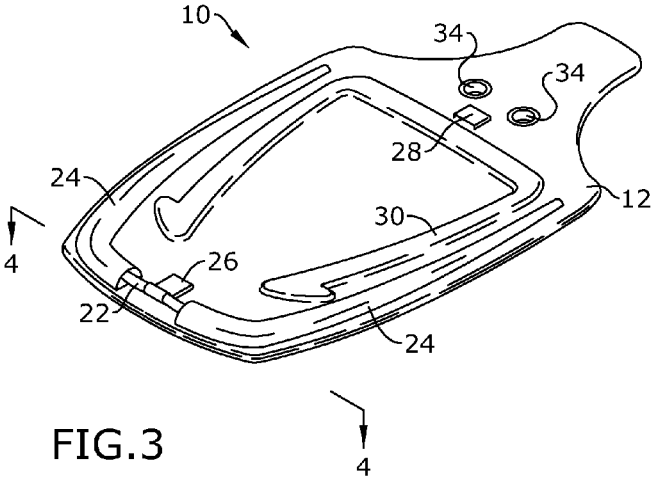
FIG. 3 depicts a bottom perspective view of certain embodiments of the shoe cover storage apparatus in a flat position.
Figure 4:
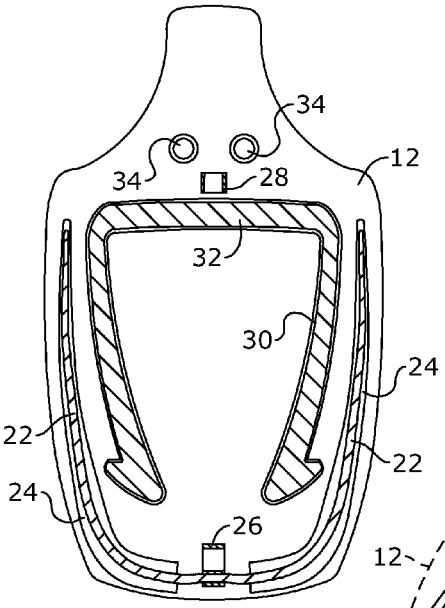
FIG. 4 depicts a section view of certain embodiments of the shoe cover storage apparatus taken along line 4-4 in FIG. 3.

As depicted in FIGS. 3-4, the bottom face of cover body 12 comprises cord 22, cord channels 24, ribbing channel 30, male cord clip 26 and female cord clip 28. A pair of cord channels 24 is positioned side by side and extends along the bottom face of cover body 12. Each cord channel 24 comprises an opening that receives a portion of cord 22. An intermediate portion of cord 22 is affixed to male cord clip 26. Cord 22 is an elastic and durable material that may be made from rubber or an alternative material. This permits a user to pull the exposed portion of cord 22 to extend the cord until male cord clip 26 engages with female cord clip 28. It shall be appreciated that alternative fasteners known in the field may be used instead of male cord clip 26 and female cord clip 28.

Ribbing channel 30 is made from a rigid or semi-rigid material and comprises a generally U-shaped member with an inner opening. Ribbing 32 is disposed within the inner opening of ribbing channel 30. Ribbing 32 is made from a semi-rigid, but flexible material such as cardboard, plastic, or the like. Ribbing 32 is provides support to cover body 12 and is configured to help the body to retain its shape. In a preferred embodiment, ribbing 32 has a slight curvature that causes cover body 12 to have a natural concave shape.

Figure 5:
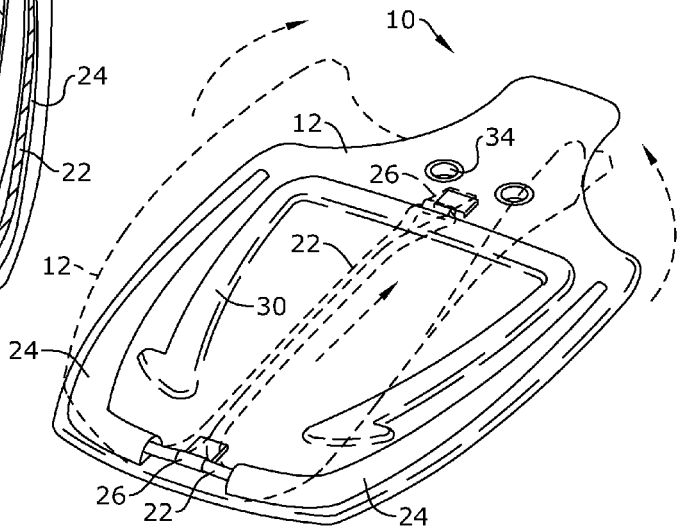
FIG. 5 depicts a bottom perspective view of certain embodiments of the shoe cover storage apparatus illustrating the pulling of cord 22 to curve cover body 12.
Figure 6:
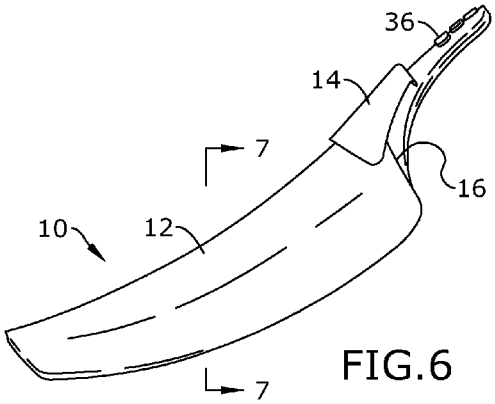
FIG. 6 depicts a side view of certain embodiments of the shoe cover storage apparatus in the normal curved position.
Figure 7:
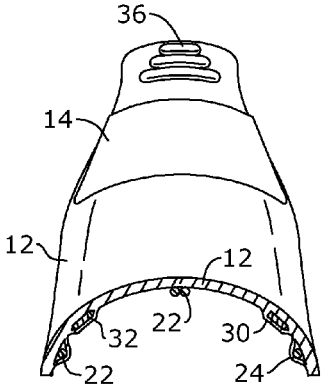
FIG. 7 depicts a section view of certain embodiments of the shoe cover storage apparatus taken along line 7-7 in FIG. 6.

As depicted in FIGS. 5-7, as cord 22 is pulled along the longitudinal axis of shoe cover storage apparatus 10, cover body 12 bends further into a concave shape to conform to contours of the upper shoe region of shoe 38. Once male cord clip 26 engages with female cord clip 28, cover body 12 retains its concave shape. Ribbing channel 30 and ribbing 32 provide additional support to cover body 12 and help shoe cover storage apparatus 10 to retain its concave shape.

Figure 8:
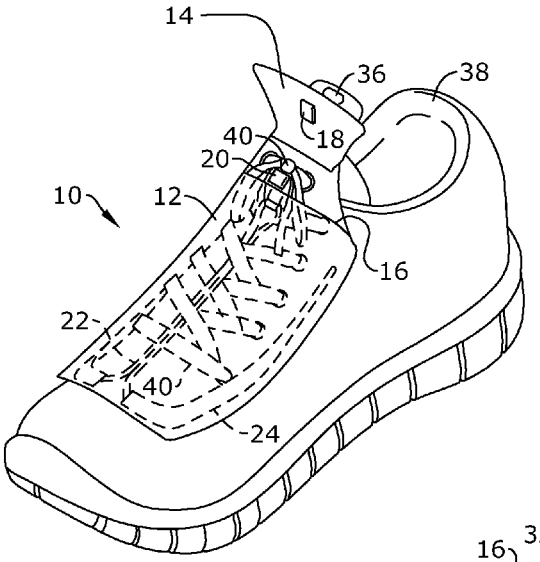
FIG. 8 depicts a perspective view of certain embodiments of the shoe cover storage apparatus shown in use.
Figure 9:
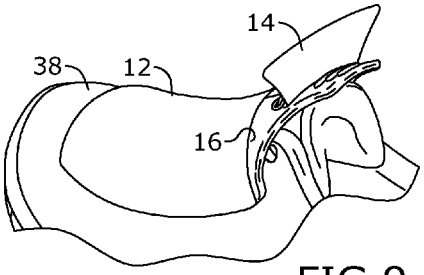
FIG. 9 depicts a rear perspective view of certain embodiments of the shoe cover storage apparatus illustrating top flap 14 pulled up to expose pocket 16.
Figure 10:
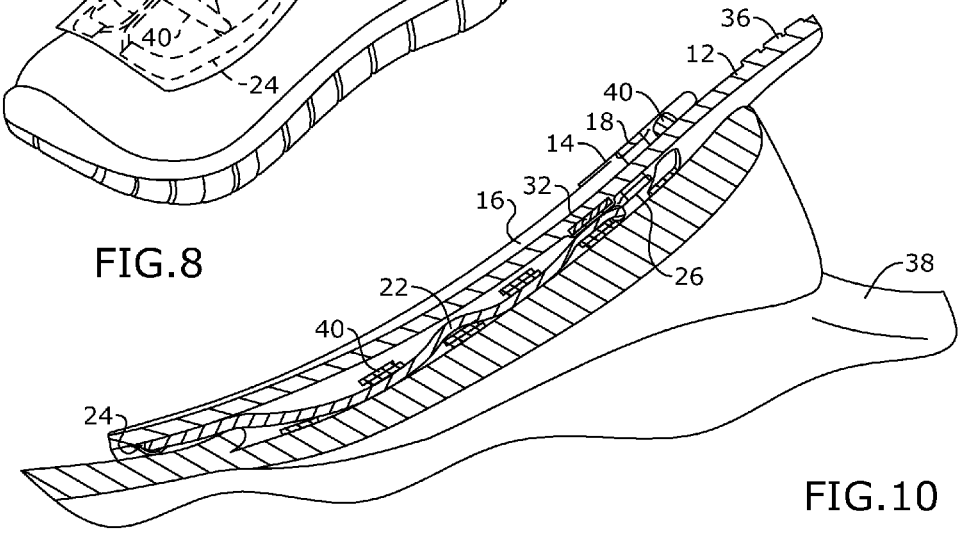
FIG. 10 depicts a section view of certain embodiments of the shoe cover storage apparatus taken along line 10-10 in FIG. 1.
Figure 11:
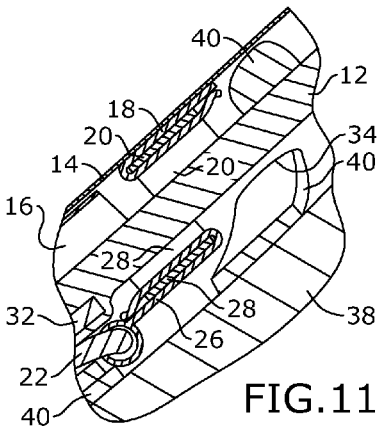
FIG. 11 depicts a section view of certain embodiments of the shoe cover storage apparatus.

In operation, shoe cover storage apparatus 10 is secured to shoe 38 by positioning cover body 12 to cover the entire upper shoe region including the shoe's laces and tongue. A user pulls the exposed portion of cord 22 to extend the cord along the longitudinal axis of cover body 12 and intertwine with shoelace 40 in an over and under configuration until male cord clip 26 engages with female cord clip 28. As depicted in FIGS. 8-9, this causes cover body 12 to bend in a concave shape that conforms to contours of the upper region of shoe 38. FIG. 10 depicts a cross-section view of cord 22 intertwined with shoelace 40 in the over and under configuration. FIG. 11 depicts the engagement of male cord clip 26 with female cord clip 28.

It shall be appreciated that the engagement of male cord clip 26 with female cord clip 28, and contact between cord 22 and shoelace 40 provide a superior fastening mechanism over prior art devices that secures the shoe cover storage apparatus 10 to shoe 38. In addition, this fastening mechanism is advantageous because cord 22 does not have any sharp edges that can damage or cause premature wear to shoelace 40.

Figure 12:
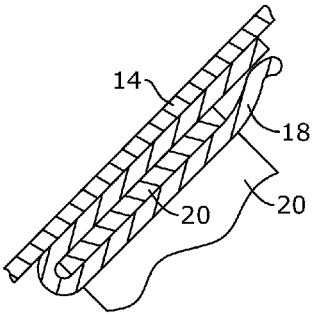
FIG. 12 depicts a section view of certain embodiments of the shoe cover storage apparatus.

The ends of shoelace 40 are fed through lace holes 34 and tied above the top face of cover body 12. The tied laces are then tucked into pocket 16. It shall be appreciated that pocket 16 is sufficiently large to store other accessories including, but not limited to, keys, rings, or other portable items. Top flap 14 is folded down over the edge of pocket 16 to cover any exposed portions of the tied laces. In one embodiment, top flap 14 comprises top male clip 18, which is configured to engage with top female clip 20 on cover body 12 as shown in FIG. 12.

Figure 13:
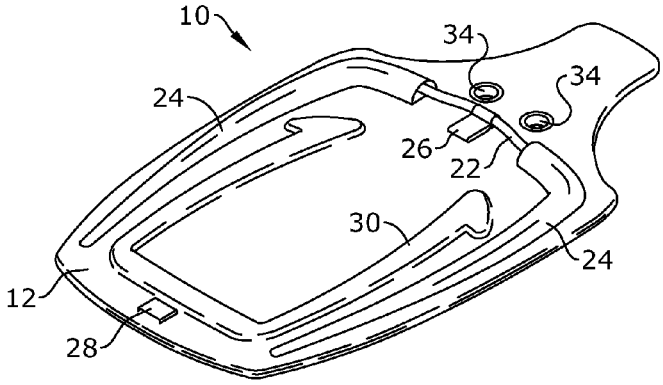
FIG. 13 depicts a perspective view of an alternative embodiment of the shoe cover storage apparatus in a flat position.
Figure 14:
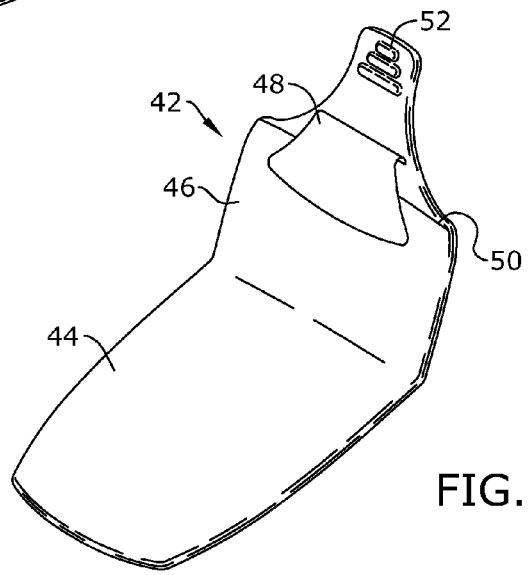
FIG. 14 depicts a perspective view of an alternative embodiment of the shoe cover storage apparatus in a flat position.
Figure 15:
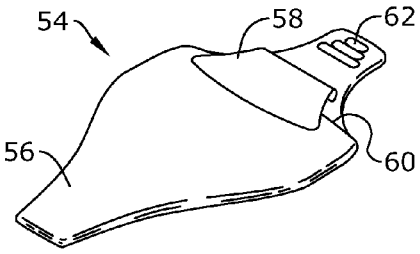
FIG. 15 depicts a perspective view of an alternative embodiment of the shoe cover storage apparatus in a flat position.
Figure 16:
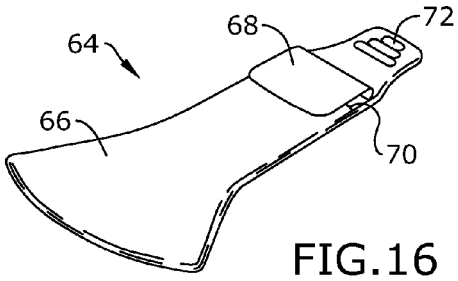
FIG. 16 depicts a perspective view of an alternative embodiment of the shoe cover storage apparatus in a flat position.

Shoe cover storage apparatus 10 may have several alternative embodiments. FIG. 13 depicts the apparatus with several components arranged in an alternate configuration, but used in substantially the same manner as disclosed above. Although the figures depict shoe 38 as having a medium height, the shoe cover storage apparatus may be secured to any alternative type of shoe, but is used in substantially the same manner as previously disclosed. FIG. 14 depicts alternative boot cover 42 for use with a high-top shoe (not shown) and comprises lower cover body 44, upper cover body 46, cover flap 48, pocket 50 and alternate gripping ribs 52. FIG. 15 depicts alternate shoelace cover 54 for use with a low-ankle athletic shoe (not shown) and comprises alternate cover body 56, alternate cover flap 58, alternate pocket 60 and alternate gripping ribs 62. FIG. 16 depicts alternate shoelace cover 64 for use with a low-ankle athletic shoe (not shown) and comprises alternate cover body 66, alternate cover flap 68, alternate pocket 70 and alternate gripping ribs 72.

It shall be appreciated that the components of the shoe cover storage apparatus described in several embodiments herein may comprise any alternative known materials in the field and be of any color, size and/or dimensions. It shall be appreciated that the components of the shoe cover storage apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A shoe cover storage apparatus to secure and protect laces of a shoe, the apparatus comprising an enhanced securement mechanism configured to permit the apparatus to conform to contours of an upper region of the shoe, the shoe cover storage apparatus comprising:

a flexible member configured to detachably couple to the upper shoe region and comprising a top face, a bottom face and a pair of openings configured to permit a portion of the laces to pass therethrough to extend above the top face;

a pocket coupled to the top face of the flexible member and configured to store the portion of the laces;

a first clip coupled to the bottom face of the flexible member;

a fastener assembly coupled to the bottom face of the flexible member and comprising channel members coupled thereto and an elastic cord slidably mounted to interior openings of the channel members, the elastic cord comprising a second clip on an exposed portion of the cord located proximate a lower portion of the flexible member; and a support member coupled to the bottom face of the flexible member and configured to help retain the flexible member in a concave shape, the support member comprising a generally U-shaped channel member and a ribbing member disposed within an opening in the U-shaped channel member;

wherein when a user pulls the second clip to extend the cord along a longitudinal axis of the flexible member to intertwine the cord with the laces of the shoe to permit the second clip to detachably couple to the first clip, the flexible member is enabled to bend into a concave shape that conforms to the upper shoe region.

2. The shoe cover storage apparatus of claim 1, further comprising a flap coupled to the top face of the flexible member, wherein the flap is configured to be detachably coupled to the top face of the flexible member to permit the flap to cover an edge of the pocket.

3. The shoe cover storage apparatus of claim 2, further comprising gripping ribs disposed on the top face of the flexible member proximate the flap.

4. The shoe cover storage apparatus of claim 3, wherein the first clip comprises a female fastening component and the second clip comprises a male fastening component.

* * * * *